US006167220A

United States Patent [19]

Lewis et al.

[11] Patent Number: 6,167,220

[45] Date of Patent: Dec. 26, 2000

[54] ANTI-CONDENSATION BAFFLE UNIT

[75] Inventors: Carl B. Lewis, Webster; Stan A. Spencer, Rochester; Susan M. Aurand; Eric C. Shih, both of Fairport; Joseph S. Vetromile; William M. Harney, both of Rochester; Martin J. Demuth, Macedon, all of N.Y.

[73] Assignee: Xerox Corporation, Stamford, Conn.

[21] Appl. No.: 09/434,461

[22] Filed: Nov. 5, 1999

[51] Int. Cl.[7] ..... G03G 21/00

[52] U.S. Cl. ..... 399/92; 399/97

[58] Field of Search ..... 399/91, 92, 97, 399/320, 322, 397; 271/194, 197; 165/222

[56] References Cited

U.S. PATENT DOCUMENTS 5,086,209 2/1992 Kintz et al. ..... 399/92 X 5,132,731 7/1992 Oda ..... 399/92

5,557,388 9/1996 Creutzmann et al. ..... 399/92

5,749,039 5/1998 Thomas ..... 399/397

*Primary Examiner*—Sophia S. Chen

*Attorney, Agent, or Firm*—Oliff & Berridge, PLC

[57] ABSTRACT

An anti-condensation baffle unit having two members which correspond to each other, which copied paper is transferred between the two members by at least one idler roller, and at least one muffin fan attached to the baffle unit to cool the area surrounding the baffle unit and the paper that passes through the baffle unit. The baffle unit further includes a plurality of slots, positioned such that the edge of the paper will not be caught by and consequently jam, which allow the air blown from fan to contact the paper and allows ventilation throughout the copying procedure.

7 Claims, 3 Drawing Sheets

ANTI-CONDENSATION BAFFLE UNIT

BACKGROUND OF THE INVENTION

1. Field of Invention

This invention relates to a conveying apparatus usable with, in particular, coated printed products.

2. Description of Related Art

Various systems designed for transporting a copy sheet in a predetermined path have a number of devices which function to affect and control movement of the sheet while it is advanced along the predetermined path within the printing apparatus. Examples of such sheet control devices include sheet grippers and sheet guides. Some of these sheet devices are fixed at various stationary locations adjacent the predetermined path. Consequently, these stationary sheet control devices act on the sheet as the sheet is transported past each stationary sheet control device. Some systems have multiple sheet control devices that are moved in and out of an operative position. In this case, each multiple sheet control device is moved by a separate and distinct solenoid or other force applying mechanism.

SUMMARY OF THE INVENTION

One of the problems within such a printing apparatus is that the various temperatures of the individual components throughout the various regions of the printing apparatus cause condensation to form within the printing apparatus and on one or more of its various components.

Condensation causes many problems within the printing apparatus and to the sheets. First, the formation of water on the individual components of the printing apparatus can damage the parts. Second, the water that condenses on the members and sheets causes paper jams within the printing apparatus. The condensation causes the sheets to stick to the surfaces of the printing apparatus and to other sheets within the printing apparatus. Additionally, when condensation forms on the paper guides and the paper guides come in contact with a sheet of coated paper, the drag coefficient rises dramatically, and can be up to 5 times higher than without the condensation. The combination of condensation and the high drag can cause sheet skew and/or sheet stall in the paper path.

Conventionally, this condensation problem has been attacked by creating slots within the paper guide. However, this has not completely disposed of the condensation that has formed and also often causes the corners of the leading edge of the sheet to jam within the slots.

This invention provides printing apparatus structures and operating methods that reduce condensation and paper jamming that occurs within a printing apparatus.

This invention places a plurality of fans throughout the printing apparatus located by one of the baffles. The fans flush the moist air from the area and bring in dry air.

This invention provides an image forming apparatus that is less susceptible to humidity-related faults.

This invention separately provides an image forming apparatus in which condensation is less likely to form.

This invention separately provides an image forming apparatus that has improved air flow and/or humidity control in baffled areas.

This invention further provides an image forming apparatus that has at least one baffle unit that includes a fan that provides improved air flow through that baffle unit to reduce the humidity in the baffle unit and areas around the baffle unit.

This invention further provides an image forming apparatus that has at least one baffle unit that includes an improved layout of the slots in that baffle unit.

In one exemplary embodiment of a printing apparatus that can beneficially incorporate the printing apparatus structures and operating methods according to this invention, after an electrostatic latent image is recorded on a photoconductive member, the latent image is developed by bringing a developer material into contact with the photoconductive member. Generally, the developer material comprises toner particles that adhere triboelectrically to carrier granules. The toner particles are attracted to the latent image from the carrier granules to form a developed image on the photoconductive member. This developed image is subsequently transferred to a sheet. The copy sheet is then heated to permanently affix the toner of the developed image to the sheet. After exiting the fuser portion of the printing apparatus, the sheet is relatively warm. The developed sheet is then received by a baffle that is much cooler. This change in temperature between the relatively warmer sheet and the relatively cooler baffle causes humidity to form and propagates the formation of water droplets formed from condensation. The condensation that is created occurs when the fuser heats the sheet of recorded material and the moisture that evaporates from the sheets over time in the paper guides that follow the fuser portion. The relative humidity of the air between the paper guides thus increases. Eventually, the dew point is reached, particularly at the cool baffle surface, and condensation forms on the surface of the paper guides.

These and other features and advantages of the systems and methods of this invention are described in or are apparent from the following detailed description of various exemplary embodiments.

BRIEF DESCRIPTION OF THE DRAWINGS

The invention will be described in relation to the following drawings, in which reference numerals refer to like elements, and wherein.

DETAILED DESCRIPTION OF PREFERRED EMBODIMENTS

Figure 1:
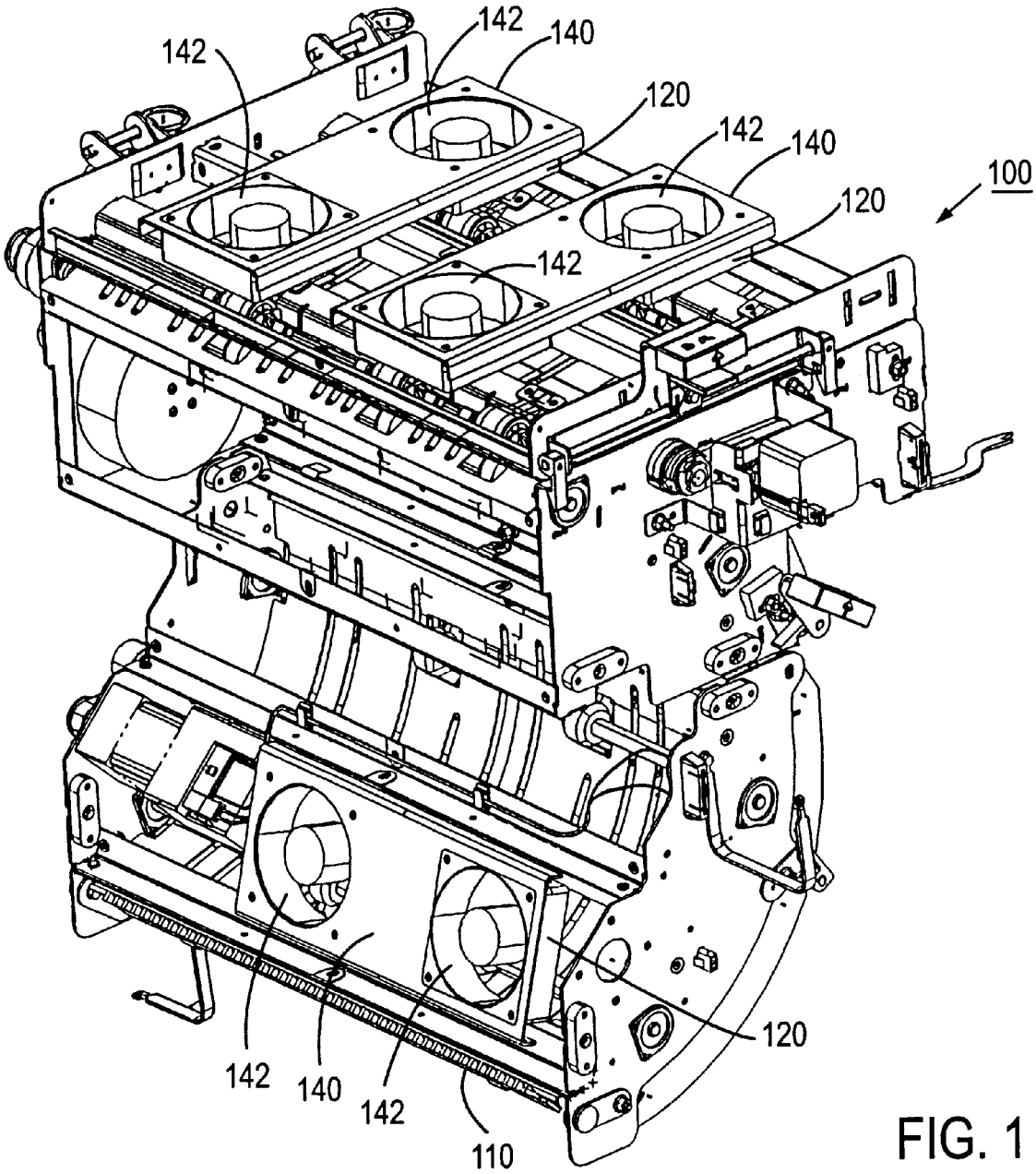
FIG. 1 is a perspective view of the transport region after paper exits the fuser.

FIG. 1 shows a turn transport 100 of an image forming apparatus, which is generally located after the fuser. The turn transport is not shown installed in the paper path of the image forming apparatus. Upon entering the fuser, toner on the sheet of recording media is heated to permanently affix the toner to the sheet. After exiting the fuser, the sheet is received by the turn transport 100 near a top entrance portion 110 near the area around reference 142. Thus, upon entering the transport 100 the sheet is in a heated state. The sheet enters the turn transport 100 and is received by a number of baffles or paper guides 120. Each of the paper guides or baffles 120 transfers the sheet from one area of the turn transport 100 to another area. The several baffles 120 are located in various areas of the turn transport 100 and are designed to transfer the sheet along a predetermined path.

A plurality of muffin fans units 140 are placed on the turn transport 100. Each muffin fan unit 140 is located near one of the baffles 120. Each muffin fan 140 has one or more fan units 142. In the various exemplary embodiments shown in FIGS. 1 and 2, each muffin fan unit 140 has a pair of fans 142.

Figure 2:
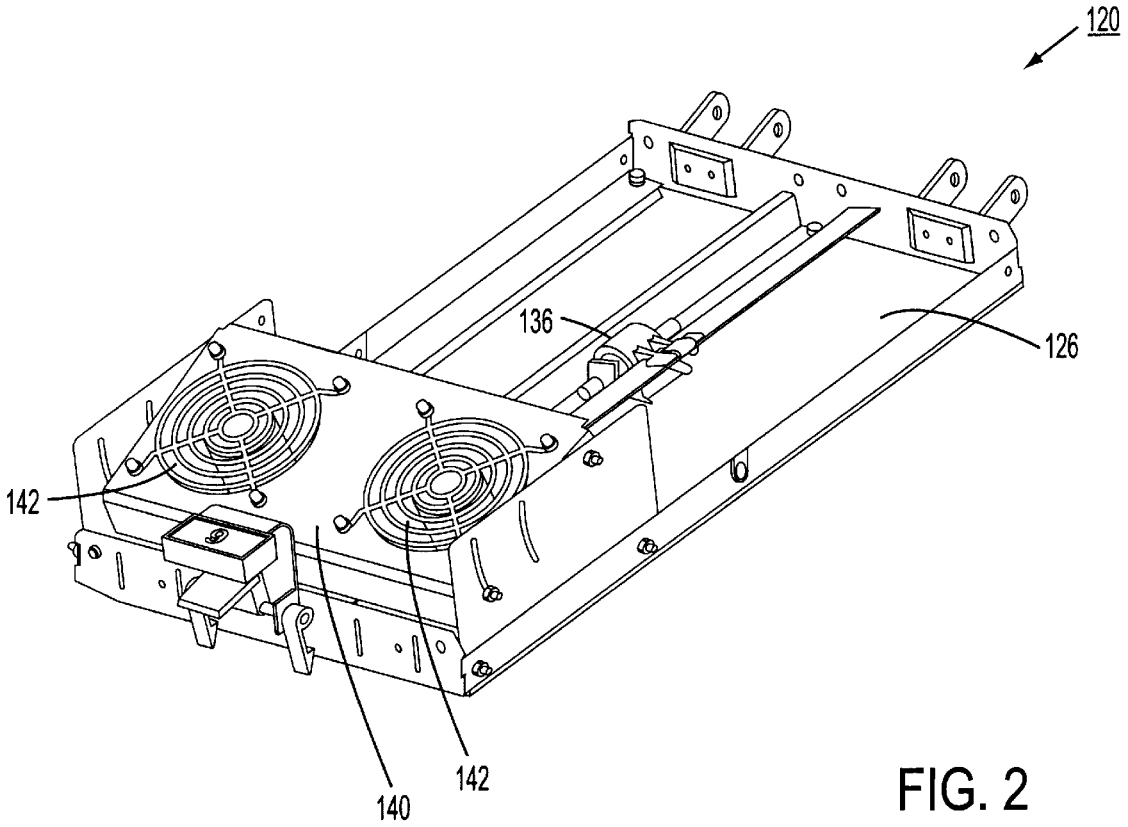
FIG. 2 is a top perspective view of the baffle unit.
Figure 3:
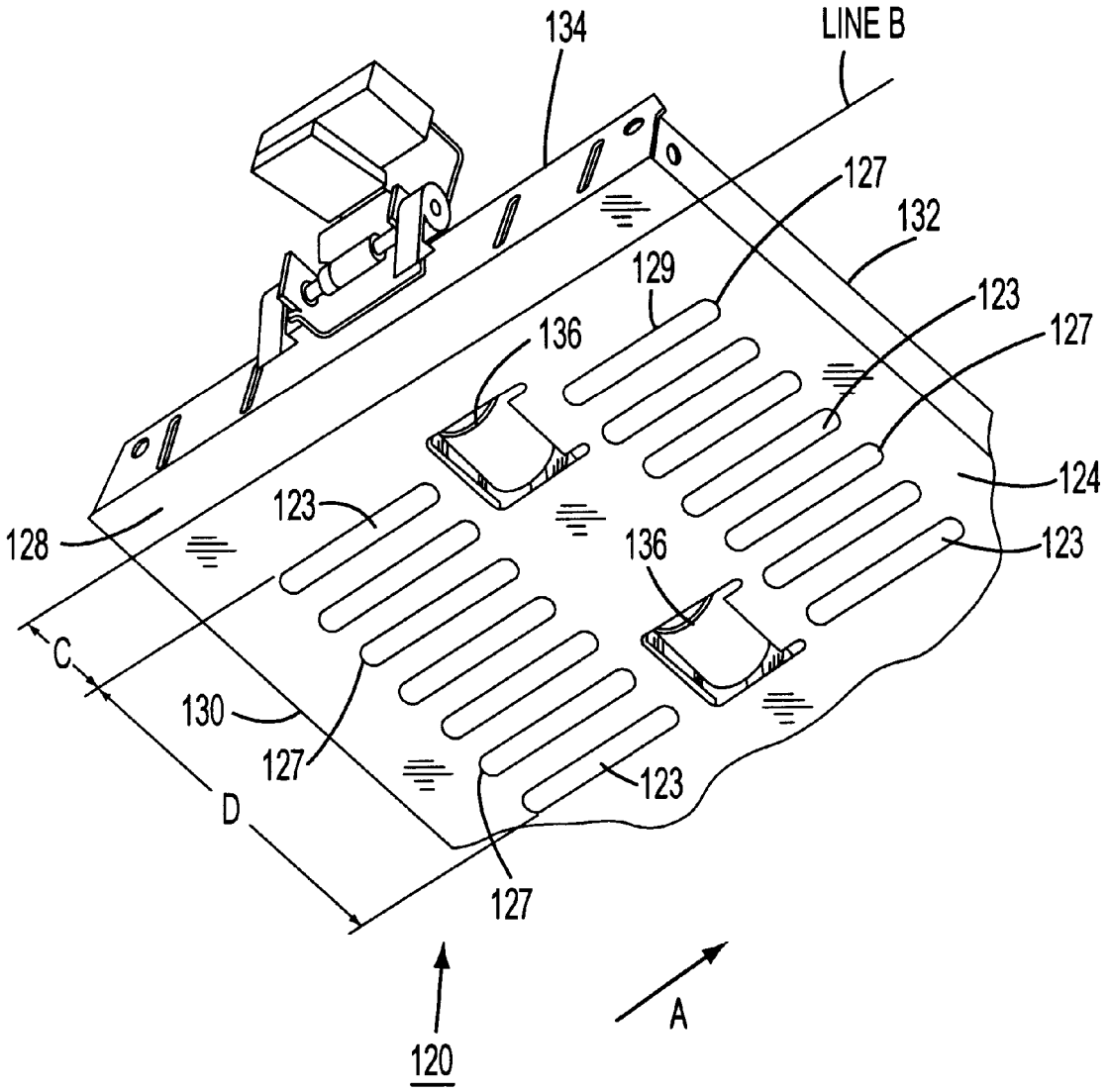
FIG. 3 is a bottom perspective view of the baffle unit.

FIGS. 2 and 3 show one exemplary embodiment of the baffle 120 in greater detail. FIG. 2 is a top perspective view of a baffle 120 showing the corresponding muffin fan unit 140. FIG. 3 is a bottom perspective view of that baffle 120. The baffle 120 shown in FIGS. 2 and 3 comprises at least two members 124. In this exemplary embodiment of the baffle 120, the members 124 are formed of metal. Each member 124 has a generally rectangular shape, with a top surface 126, a bottom surface 128, a front edge 130, a back edge 132, and a two side edges 134. In the turn transport 100, various exemplary embodiments of the baffles 120 have a nickel coating. The top surface 126 of one member 124 opposes the bottom surface 128 of the other member 124. The sheet being transferred is fed in between the two members 124 and is aided in its motion by at least one idler roll 136. In the exemplary embodiment of the baffle 120 shown in FIGS. 2 and 3, the baffle 120 includes a pair of idler rolls 136.

The baffle 120 has a plurality of slots 123 which run in the direction in which the sheet is transferred by the baffle 120, as indicated by the arrow A. The slots 123 are generally straight in shape and have a sloped lead in portion 127 and preferably coined edges 129. In conventional twin transports, as a sheet travels through a conventional baffle, or as the sheet enters each baffle, the corners of the leading edge of the sheet stick in the end portion of the slots of the conventional baffle. According to the printing apparatus structures and operating methods according to this invention, the baffles 120 are designed so that the sheet received by the baffles 120 is edge registered. That is, the outboard edge of a sheet is positioned along line B, while, in the exemplary embodiment shown in FIGS. 2 and 3, the sheet has a width of at least 6 inches.

A distance between the line B and the edge of a first slot 123 should be in the range of about 0.01 inches to about 0.49 inches. In the exemplary embodiment shown in FIGS. 2 and 3, the distance D over which the slots 123 extend should be in the range of about 5 to about 6 inches. The distance D is about 5.5 inches and a distance C is about 0.25 inches. Therefore, because the slots 123 are designed to be positioned as described above, the corners of the sheet do not get caught in the slots 123 as the sheet is transferred through the baffles 120. The slots 123 also allow ventilation air flow generated by the fans 142 to flow between the two baffle members 124 and contact the paper.

The muffin fan units 140 are attachably connected to the baffles 120 by one or more fasteners or any other attachment structure that is capable of attaching the muffin fan units 140 to the baffles 120. Each muffin fan units 140 may be connected to the corresponding baffles 120 by screws, nails, clips, rivets, hooks, velcro, or other known or later developed fasteners. Alternatively, each muffin fan unit 140 can be attached to the corresponding baffle 120 by welding, soldering, brazing, adhesives, or any other known or later developed technique for maintaining each muffin fan unit 140 in a predetermined relationship with the corresponding baffle. For example, the muffin fan units 140 can be attached to components of the turn transport 100 other than the baffle 120, using one of the techniques or devices discussed above, so long as that muffin fan is maintained in the desired relative position to the corresponding baffle 120.

The fans 142 are used to provide either positive or negative pressure to control the air flow through the corresponding baffle 120. The air blown from the fans 142 exchanges the moist air with cooler dry air and also the heated sheet being transferred through the baffle 120. While the sheet passes through the baffles 120, the air blown by the fans 142 through the slots 123 located in the baffle members 124 contacts the sheet. In the exemplary embodiment of the turn transport 100 shown in FIG. 1, the muffin fan units 140 are placed on top of the post fuser path baffles 120. Also, the muffin fans 142 should be placed at least 2 inches away from the slots 123 so that air may circulate around the environment and the air blown does not move or otherwise skew the paper being transferred.

This is especially useful in reducing condensation on coated paper. The inventors have determined that coated paper more slowly releases water vapor from the sheets due to the coating of the paper. Additionally, as water condenses on the baffles 120, and comes in contact with a coated sheet, the drag coefficient between the coated sheet and the baffle members 124 goes up to a value >5 or $U_f$>5. The combination of condensation and increased drag can cause the sheet to skew and/or stall in the paper path.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. An anti-condensation baffle unit, comprising:

two members opposing each other, a sheet of recording material capable of passing between the two members;

at least one idler roll located on at least one of the two members;

at least one slot located on each of the members; and at least one fan unit attached to the baffle unit, each fan unit circulating air through the slots.

2. The baffle unit in claim 1, wherein the slots have a lead in portion.

3. The baffle unit of claim 1, wherein the slots have coined edges.

4. The baffle unit of claim 1, wherein the at least one slot of the baffle unit includes a first slot, a final slot and at least one intermediate slot located between the first slot and the final slot, wherein the distance between the first slot and the second slot is less than six inches.

5. The baffle unit of claim 4, wherein the distance between the first slot and the second slot is about five and one-half inches.

6. The baffle unit of claim 1, wherein each at least one fan unit is a muffin fan unit including at least one muffin fan.

7. The baffle unit of claim 1, wherein each at least one fan unit is positioned at least 2 inches away from the at least one slot.

* * * * *